US007942342B2

(12) United States Patent
Powers et al.

(10) Patent No.: US 7,942,342 B2
(45) Date of Patent: May 17, 2011

(54) RAILWAY TIE OF NON-HOMOGENEOUS CROSS SECTION USEFUL IN ENVIRONMENTS DELETERIOUS TO TIMBER

(76) Inventors: Scott Powers, Rockford, MI (US); Jonathan Jaffe, Gallatin, TN (US)

( * ) Notice: Subject to any disclaimer, the term of this patent is extended or adjusted under 35 U.S.C. 154(b) by 464 days.

(21) Appl. No.: 11/739,954

(22) Filed: Apr. 25, 2007

(65) Prior Publication Data

US 2008/0265047 A1 Oct. 30, 2008

(51) Int. Cl.
*B32B 21/00* (2006.01)

(52) U.S. Cl. ..... 238/84; 238/95

(58) Field of Classification Search ..... 238/84, 238/95, 96, 97, 98, 99, 100, 101, 102, 103
See application file for complete search history.

(56) References Cited

U.S. PATENT DOCUMENTS

| | | | | |
|---|---|---|---|---|
| 1,418,708 | A | 6/1922 | Hardman | |
| 1,463,979 | A * | 8/1923 | Stubbs | 404/82 |
| 2,157,456 | A * | 5/1939 | Koyemann | 428/609 |
| 2,490,548 | A * | 12/1949 | Schultz | 29/898.058 |
| 2,963,294 | A * | 12/1960 | Buck | 482/30 |
| 3,939,617 | A | 2/1976 | Eisses | |
| 4,079,889 | A | 3/1978 | Halpenny | |
| 4,083,491 | A | 4/1978 | Hill | |
| 4,105,159 | A | 8/1978 | Brown | |
| 4,108,377 | A | 8/1978 | Potter | |
| 4,134,546 | A | 1/1979 | Dankert | |
| 4,151,145 | A | 4/1979 | Emig et al. | |
| 4,202,494 | A * | 5/1980 | Rumell | 238/83 |
| 4,204,660 | A | 5/1980 | Feuillade | |
| 4,236,670 | A | 12/1980 | Limmergard et al. | |
| 4,265,400 | A | 5/1981 | Jordon | |
| 4,416,419 | A | 11/1983 | Ohno | |
| 4,438,028 | A * | 3/1984 | Schmittmann et al. | 252/609 |
| 4,449,666 | A | 5/1984 | Hales et al. | |
| 4,634,049 | A | 1/1987 | Steinfeld et al. | |
| 4,652,495 | A | 3/1987 | Sato et al. | |
| 4,715,425 | A * | 12/1987 | Brosch | 164/418 |
| 4,738,878 | A | 4/1988 | Anderson et al. | |
| 5,043,225 | A | 8/1991 | Ostby et al. | |
| 5,055,350 | A | 10/1991 | Neefe | |
| 5,170,937 | A | 12/1992 | Vanotti | |
| 5,230,459 | A * | 7/1993 | Mueller et al. | 228/164 |
| 5,236,711 | A | 8/1993 | Ostby et al. | |
| 5,314,115 | A | 5/1994 | Moucessian | |
| 5,353,987 | A | 10/1994 | Kusakabe et al. | |
| 5,540,382 | A | 7/1996 | Scheller | |
| 5,609,295 | A | 3/1997 | Richards | |
| 5,713,517 | A | 2/1998 | Loison | |
| 5,713,518 | A | 2/1998 | Fox et al. | |
| 5,722,589 | A | 3/1998 | Richards | |

(Continued)

FOREIGN PATENT DOCUMENTS

| | | |
|---|---|---|
| EP | 0 440 597 A | 8/1991 |

(Continued)

*Primary Examiner* — Mark T Le
(74) *Attorney, Agent, or Firm* — Cook Alex Ltd.

(57) ABSTRACT

A railroad tie comprises a core comprising wood or a wood product, and a first sleeve encapsulating the core, wherein the first sleeve comprises at least one of the group consisting of plastic, plastic-composite, or non-plastic polymers. A second sleeve may additionally encapsulate the first. In a preferred embodiment, the first sleeve is comprised primarily of poly ethylene terephthalate, and the second sleeve is comprised primarily of high density poly ethylene.

20 Claims, 11 Drawing Sheets

U.S. PATENT DOCUMENTS

| | | | | |
|---|---|---|---|---|
| 5,799,870 | A | 9/1998 | Bayer | |
| 5,826,791 | A | 10/1998 | Broughton | |
| 5,886,078 | A | 3/1999 | Sullivan et al. | |
| 5,916,932 | A | 6/1999 | Nosker et al. | |
| 6,021,958 | A | 2/2000 | Smith | |
| 6,059,199 | A | 5/2000 | Eriksson et al. | |
| 6,070,806 | A | 6/2000 | Barbakadze et al. | |
| 6,191,228 | B1 | 2/2001 | Nosker et al. | |
| 6,237,856 | B1 | 5/2001 | Bachmann et al. | |
| 6,247,651 | B1 | 6/2001 | Marinelli | |
| 6,503,193 | B1 * | 1/2003 | Iwasaki et al. | 600/140 |
| 6,708,896 | B2 | 3/2004 | Robinson | |
| 6,749,103 | B1 * | 6/2004 | Ivanov et al. | 228/115 |
| 6,766,963 | B2 | 7/2004 | Hansen | |
| 6,828,372 | B2 | 12/2004 | Sullivan et al. | |
| 7,011,253 | B2 | 3/2006 | Nosker et al. | |
| 7,138,437 | B2 | 11/2006 | Giorgini et al. | |
| 7,147,169 | B2 | 12/2006 | Walsh | |
| 7,156,319 | B2 | 1/2007 | Kowalski | |
| 7,220,458 | B2 * | 5/2007 | Hollis et al. | 427/446 |
| 2002/0062545 | A1 * | 5/2002 | Niedermair | 29/417 |
| 2005/0106406 | A1 * | 5/2005 | Curtis et al. | 428/537.1 |
| 2006/0246265 | A1 * | 11/2006 | Rogers et al. | 428/195.1 |
| 2007/0187522 | A1 * | 8/2007 | Kirchmer et al. | 238/84 |
| 2008/0032046 | A1 * | 2/2008 | Sporn et al. | 427/299 |
| 2008/0179418 | A1 | 7/2008 | Brough et al. | |

FOREIGN PATENT DOCUMENTS

| | | | |
|---|---|---|---|
| GB | 2 030 200 | A | 4/1980 |
| GB | 2 087 320 | * | 5/1982 |
| WO | 97/20108 | A | 6/1997 |
| WO | 2007/009362 | A | 1/2007 |

* cited by examiner

RAILWAY TIE OF NON-HOMOGENEOUS CROSS SECTION USEFUL IN ENVIRONMENTS DELETERIOUS TO TIMBER

BACKGROUND OF INVENTION

The purpose of a railroad tie is to connect the earth, or other intermediate supporting base, to plates which connect to rails. They also provide for the proper spacing (gauge) between rails. In turn the rails support locomotives, passenger, freight or service cars as they transit or park.

FIG. 1 shows the cross section of a treated timber tie 10 in a common cross section of seven inches (7") tall and nine inches (9") wide. Common lengths for cross ties are eight feet (8'), eight foot and six inches (8'-6") and nine feet (9'). Switch ties are longer. In this drawing the pressured applied preservative 20 does not penetrate through the entire tie. There is a core 30 that may remain untreated.

Railroad ties are traditionally made of wood, though some are of concrete or all-plastic or plastic-composite. There are several standard sizes, one common size being seven inches tall by nine inches wide by nine feet long. Other standards include cross sections of 6"×8", 6"×9" and lengths of 8'-0" and 8'-6".

Ties must be strong enough to maintain support and gauge under lateral loads, static vertical loads, and dynamic vertical loads. The tie must be resistant to the dynamic load which can cause the tie plate to move and abrade the tie. The tie must be able to function despite environmental stresses of thermal expansion, ultraviolet (UV) radiation, attack from microorganisms, fungi, insects and other life forms. It is highly preferable that ties be installable using the existing base of standardized installation equipment and fasteners. Some rail systems use a "third rail" to conduct power to trains. For this and other reasons, railroad ties should not be conductors of electricity.

The predominant tie in service is a hardwood timber treated with creosote, coal tar, chromated copper arsenate or other preservative. Over time these preservatives leach from the tie to the surrounding earth and eventually migrate to the surrounding areas, including water tables. There are few safe methods for disposing of treated timber ties. Stacking them in landfills does little to retard leaching. Open air burning releases the toxins into the atmosphere. Closed effluent burning with contaminant capture is expensive.

Because concrete and reinforced concrete ties are highly inflexible they do not allow a flex-and-resume support of the rails. More concrete ties are required per mile of track which increases the cost per mile. The cost per tie is also higher. Further, the increased weight of concrete requires changes to installation equipment and procedures.

Both timber and concrete ties can accept water into cracks or grain separations. As water freezes it expands and can force the cracks wider, leading to a reduction in tie strength. For reinforced concrete ties this crack expansion can also expose the metallic reinforcing material to air, thereby initiating the deleterious effects of rust, further reducing tie strength.

More than ten million ties were installed as new or replacements during each of 2003-2006. With thousands of ties per mile, the introduction of a functionally equivalent or superior, longer lived, and lower life cycle cost tie is materially beneficial to rail operators, maintains or improves rail system safety, and is ecologically beneficial.

Thus, there is a need for a tie with a combination of lower manufacturing times, better spike retention, increased resistance to abrasion, lighter weight, and lower cost than existing concrete, plastic or composite ties.

There is a further need for processes for manufacturing a tie having the above characteristics in an efficient and environmentally sensitive manner.

SUMMARY OF THE INVENTION

A railroad tie according to embodiments of the present invention uses a wood, composite wood, wood-plastic or engineered plastic core and is encapsulated in one to many layers of plastic, or plastic-composite materials. A complete encapsulation is also referred to as a sleeve or a jacket. Only the outer-most encapsulating layer is exposed to the elements. A single plastic layer is, or multiple layers are, applied in a high pressure mold to promote adhesion between the core and adjacent plastic layer as well as between layers to increase strength. High pressure also helps the plastic or plastic-composite material to displace voids in the core with the result being a stronger and longer lasting product than natural wood could provide.

The core may be an old tie removed from service, but is still adequately strong. It may be trimmed to size and encapsulated. The encapsulation retards leaching of preservatives in the core.

Alternatively, the core may start as an unusable treated timber tie rendered into fibers. Rotten or otherwise undesirable fibers are separated from reusable fibers and disposed of. The reusable fibers may be mixed with a binder and formed into cores of the appropriate size. Again, the encapsulation retards leaching of any fiber-borne preservative to the environment.

The core may be an engineered wood, structured wood, wood by-product, plastic/wood beam or plastic composite.

The encapsulation may be an engineered plastic or plastic-composite section.

The top side of the outermost encapsulation may be textured or pigmented to reduce glare or provide another aesthetically pleasing or functional appearance. The underside may be patterned to increase friction with ballast or other bed material, so as to retard lateral movement. The encapsulation (s) may be colored for an aesthetic or functional purpose. Other functional or decorative moldings may be added. These include, but are not limited to, owner identification, date of manufacturing, location of manufacturing facility, mold number, lot number etc.

BRIEF DESCRIPTION OF DRAWINGS

Aspects, features, benefits and advantages of the embodiments of the present invention will be apparent with regard to the following description, appended claims and accompanying drawings where:

DETAILED DESCRIPTION OF THE INVENTION

Figure 1:
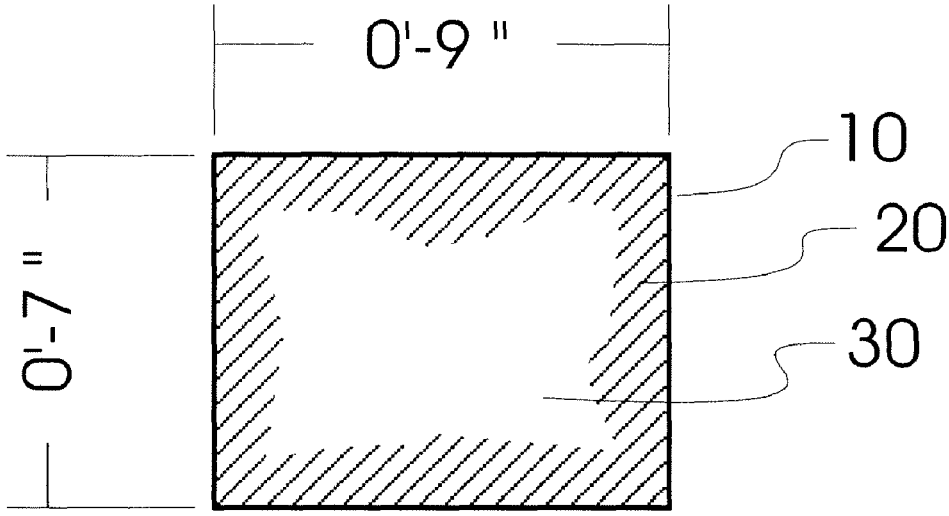
FIG. 1, a cross section of a traditional timber tie showing irregular penetration of preservative.
Figure 2:
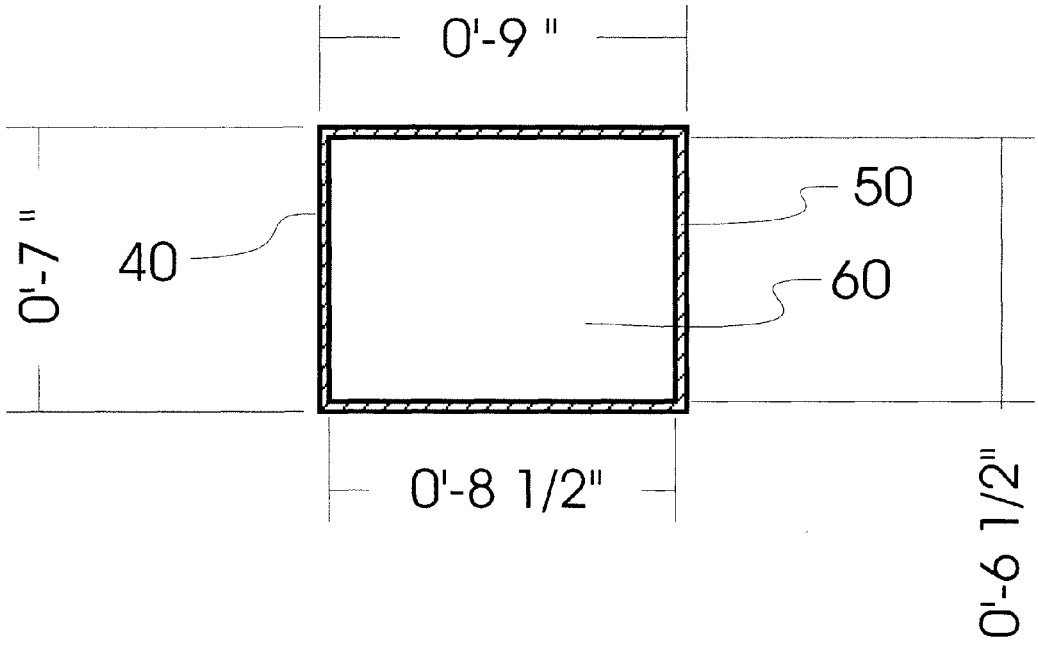
FIG. 2, a cross section of an embodiment of the invention showing a single layer encapsulation.

FIG. 2 shows a railroad tie 40 according to an embodiment of the present invention. Railroad tie 40 has a cross section of 7"×9" with a core 60 of cross section 6.5"×8.5" encapsulated in a single sleeve 50 0.25" inches thick.

Figure 3:
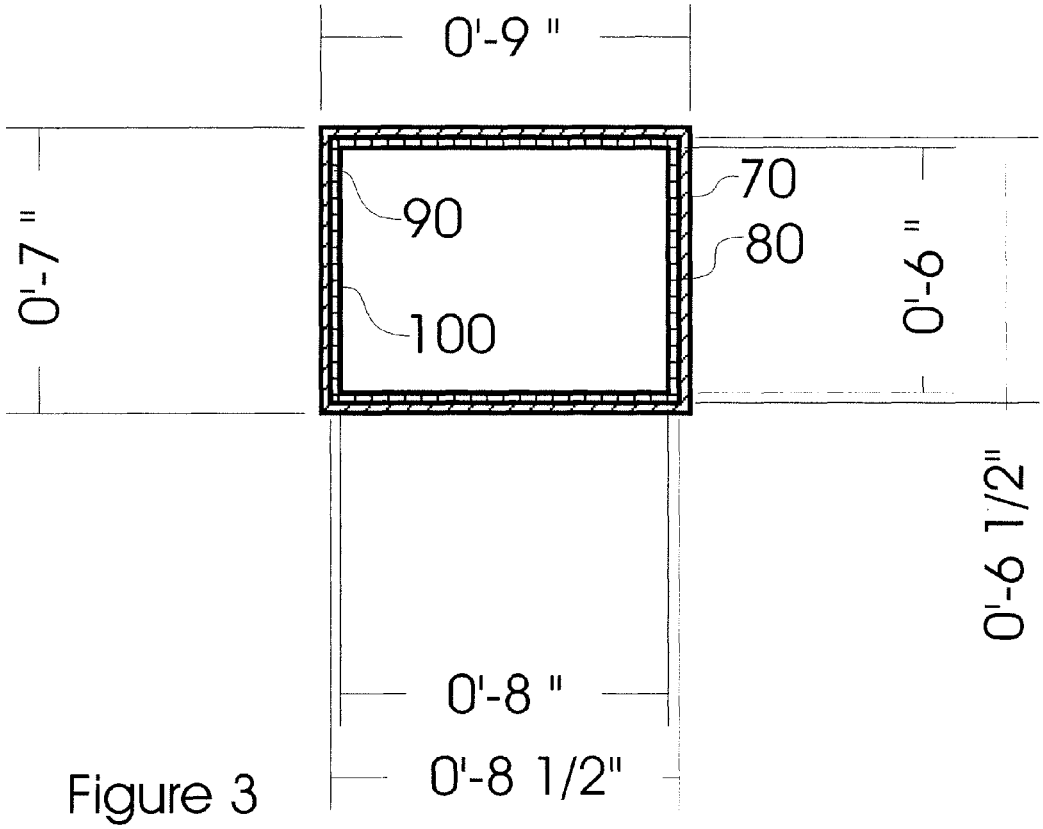
FIG. 3, a cross section of an embodiment of the invention showing a double layer encapsulation.

FIG. 3 shows a railroad tie 70 according to another embodiment of the present invention. Railroad tie 70 has a common cross section of 7"×9" with a of 6"×8" core 100, an inner sleeve 90, 0.25" in thickness, and an outer sleeve 80, 0.25" in thickness. Railroad tie 30, encapsulated in two sleeves, holds several advantages over the railroad tie 40, having only a single layer of encapsulation. First, plastic cools at a near-logarithmic rate. During the manufacturing process, a 0.25" layer may cool sufficiently after only thirty seconds. A 0.5" layer may, however, take two minutes to cool. Thus, using two layers may result in a lower manufacturing time, given the same desired final thickness. Second, using multiple sleeves allows different materials to be used for each sleeve. Third, using multiple sleeves allow the interface between the sleeves to be molded in an interlocking form, resulting in increased strength. However, it is to be understood that single, dual, or even greater levels of encapsulation are within the scope of this invention.

The cores 60 and 100 may be new treated timber ties reduced to the 6.5"×8.5" and 6"×8", respectively. Because the cores 60 and 100 are encapsulated by the sleeve 50 and sleeves 80 and 90, respectively, the preservative in the cores 60 and 100 is retarded from leaching into the surrounding environment. Further, the cores 60 and 100 are protected from the elements. Alternatively, the cores 60 and 100 may be used treated timber ties that are structurally sound, but worn towards the outer edges. The outer edges are removed in sufficient quantity to result in the cores 60 and 100 shown in FIGS. 2 and 3, respectively.

The cores 60 and 100 may alternatively be constructed from used timber ties that are no longer structurally sound, but contain sound fibers and strands.

The sleeves 50, 80 and 90 may be constructed from any number of non-plastic polymers, plastics or plastic-composites. Preferably, inner sleeve 80 is constructed from a polyester, such as poly ethylene terephthalate, or PET. The PET may be additionally be mixed with a fine rubber, such as a rubber dust, and a stabilizer. Rubber dust performs two functions. First, one of the elements in rubber dust is carbon black, which assists in adding UV resistance to the sleeves. Second, the rubber dust consumes volume and is cheaper than plastic, i.e., a filler. The stabilizer may be, for instance, FUSABOND co-polymer, manufactured by DuPont. The stabilizer may improve the compatibility between the base plastic, such as PET, and any additives, fillers, or reinforcing agents, such as the rubber dust. Sleeves 50 and 90 are preferably constructed from a polyolefin such as high density poly ethylene, or HDPE. The HDPE may be mixed with a fine rubber dust and a stabilizer, as discussed above with respect to PET. As sleeves 50 and 90 are externally visible, a colorant may be added to the HDPE to attain the desired color. Additional additives, such as scents, may be added to the HDPE. Inner sleeve 80 and outer sleeve 90 are preferably greater than 75%, by weight, of PET and HDPE, respectively.

Although not shown in FIGS. 2 and 3, the end surfaces of railroad ties 40 and 70 are also covered by the sleeves 50, and 80 and 90, respectively. The end surfaces may be unadorned, or they may be impressed with information, such as the identity of the manufacturer.

The side surfaces of railroad ties 40 and 70 are preferably smooth to reduce friction during material handing.

The upper surface railroad ties 40 and 70 may be patterned in either a decorative or functional pattern. Such functional patterns include, but are not limited to, those patterns resulting in increased friction or glare reduction.

The bottom surface of the railroad ties 40 and 70 is preferably patterned depending on the surface upon which the railroad ties 40 and 70 are intended to be placed. For instance, the railroad ties 40 and 70 may be placed in ballast, requiring one type of patterning, or on a smooth surface such as those found in smooth floored tunnels, requiring different patterning.

Figure 4A:
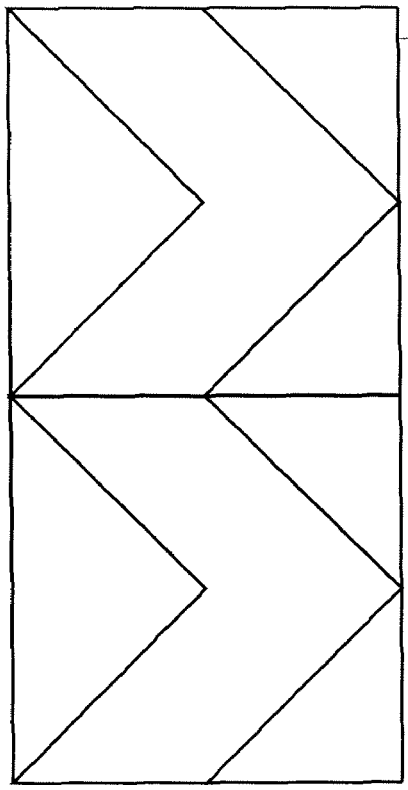
FIGS. 4A-4C illustrate pattern elements for a tie in ballast.
Figure 4B:
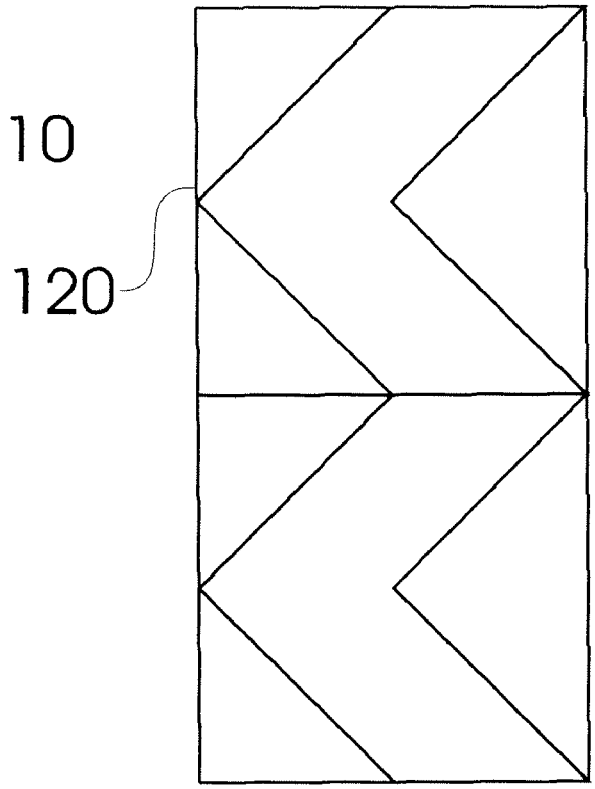
Figure 4C:
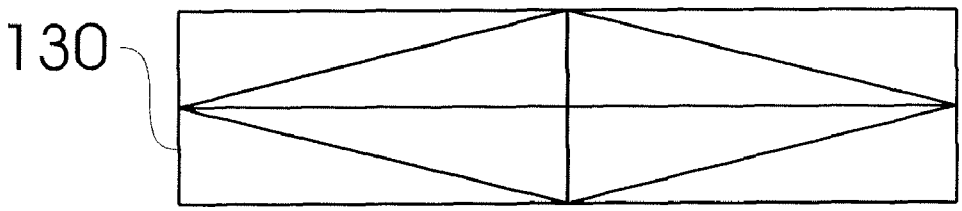

For ties that are to be placed on ballast, the tread patterns should capture the ballast material (e.g., gravel rock) to increase friction. In FIGS. 4A-4C and FIGS. 5-7, the lines indicate ridges that protrude from the surrounding surface. The ridges need not be squared, but may instead be chamfered with a draft angle. FIGS. 4A, 4B and 4C each show an embodiment of a tread pattern section. FIG. 4A is a right pointing chevron section 110, and shows two parallel chevrons each of which is bounded by three triangles. In this embodiment, the chevron section contains all 90-45-45 degree triangles, though one of ordinary skill would understand that the angles may be modified while still staying within the scope of the present invention. The chevrons are 90-degrees at the apex and 135-degrees at the sides. In this embodiment, the end result is a two square pattern. The left pointing chevron 120, shown in FIG. 4B, is a mirror image of the right pointing 110 chevron. FIG. 4C shows another section 130 composed of eight triangles (8T) where the triangles are at angles other than 90-degrees or 45-degrees. The mix of differing angles increases the probability of a rock capture and increased friction. The three patterns illustrated in FIGS. 4A, 4B and 4C may be combined in many ways to achieve a bottom surface with higher friction in ballast than a smooth bottom surface.

Figure 5:
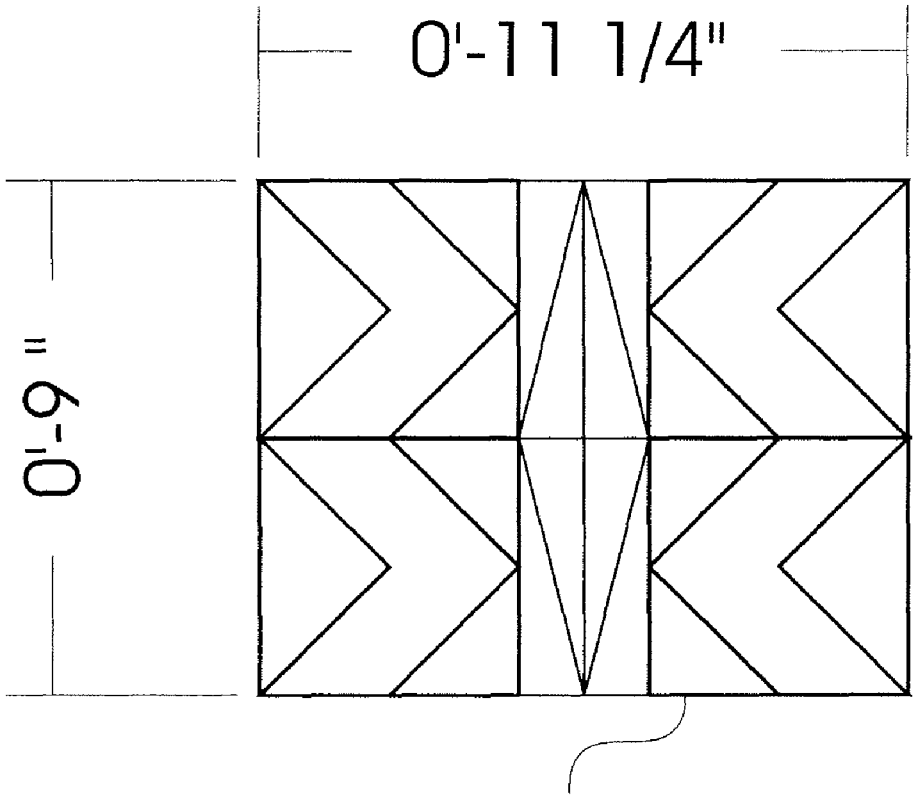
FIG. 5, the bottom of an embodiment of the showing pattern elements in pattern A.
Figure 6:
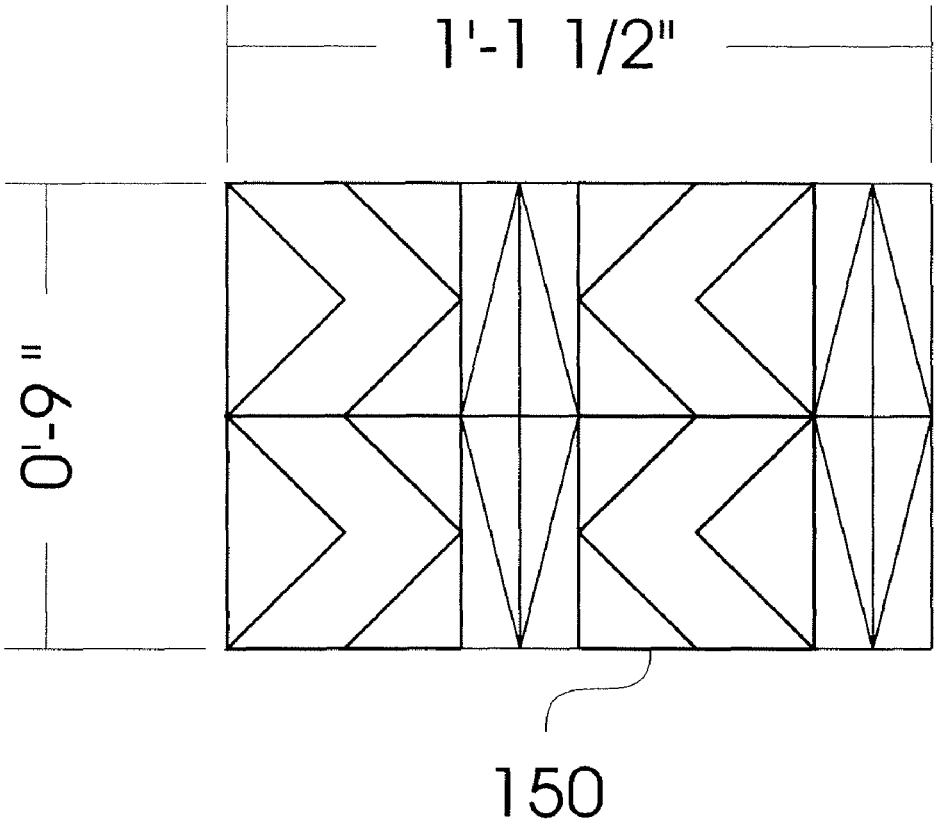
FIG. 6, the bottom of an embodiment of the showing pattern elements in pattern B.
Figure 7:
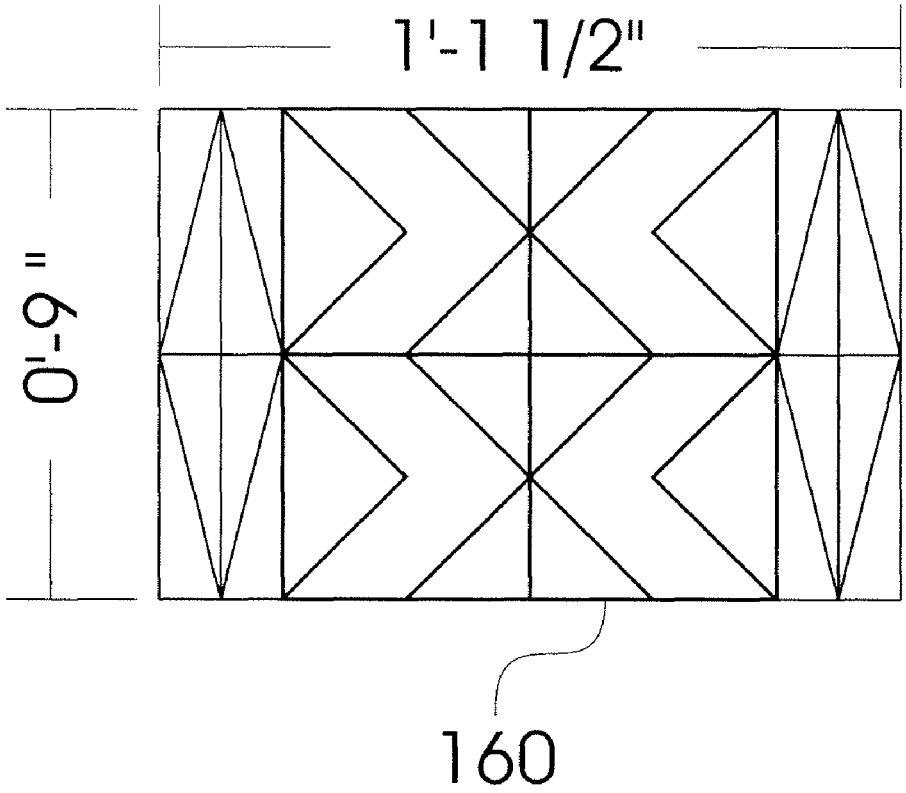
FIG. 7, the bottom of an embodiment of the showing pattern elements in pattern C.

FIGS. 5, 6 and 7 show various combinations of the sections shown in FIGS. 4A, 4B and 4C. FIG. 5 shows a combination 140 comprising one 8T section 130 placed between left pointing 120 and right pointing 110 chevron patterns. FIG. 6 shows a combination 150 comprising one 8T section 130 placed between alternating left pointing 120 and right pointing 110 chevron patterns. FIG. 7 shows a combination 160 one 8T section 130 placed before and after each pair of left pointing 120 and right pointing 110 chevron patterns. The combinations 140, 150 and 160 may be repeated over the length of the bottom surface of the tie.

The bearing surfaces of ties according to an embodiment of the present invention having a patterned bottom surface may range in width from near-zero for a knife edge to two inches (2") wide. The molding draft angle of the raised tread to the relieved section may range between 0.01-degrees (near vertical) to 89.99-degrees (near flat).

Figure 8:
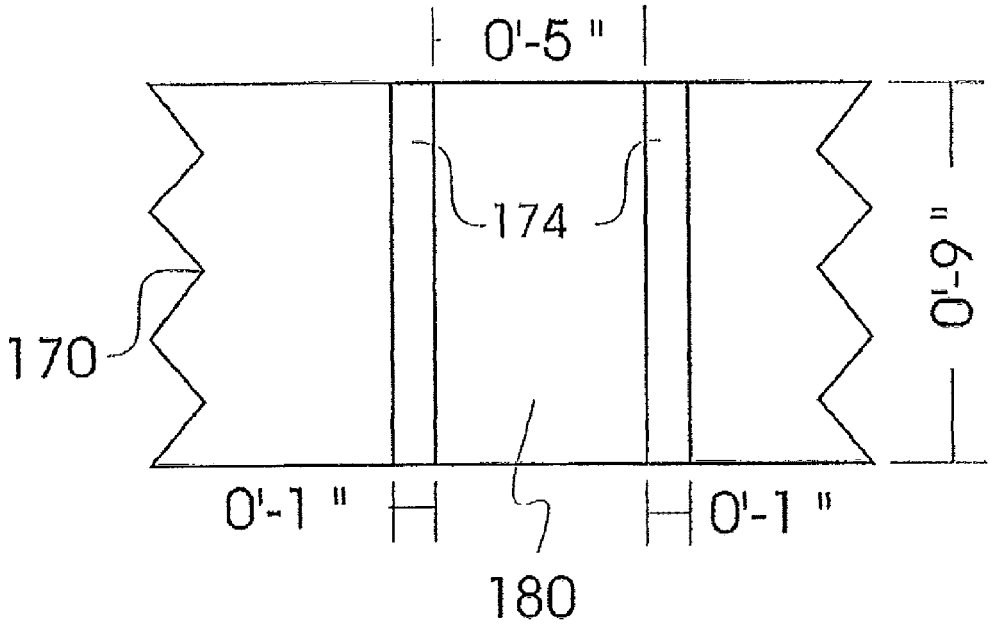
FIG. 8, a bottom view of an embodiment of the showing pattern element suitable for a tunnel.
Figure 9:
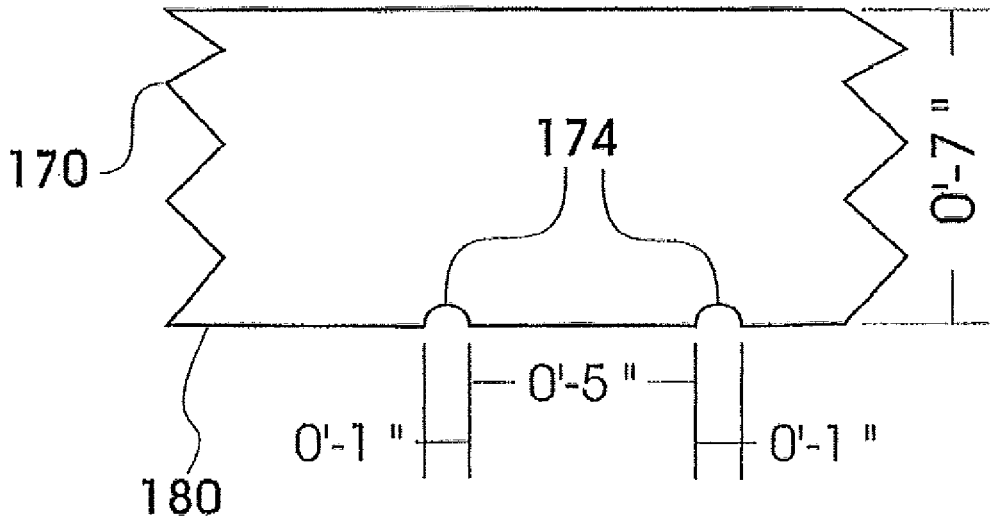
FIG. 9, a side view of an embodiment of the invention showing pattern element suitable for a tunnel.

Not all ties are placed in ballast. To improve performance in tunnels, or other smooth bottomed surfaces, FIG. 8 shows a bottom surface 180 of a tie section 170 showing one inch (1") diameter channels 174 at five inch (5") intervals. These channels are over the length of the tie. FIG. 9 shows a side surface or the tie section 170 showing the same spacing and channels 174 along the bottom surface 180. Although the 5" spacing and 1" diameter are shown here, other combinations of spacing, diameter, and shape are possible. The channels allow for drainage.

Hereinafter, a preferred method of manufacturing the tie shown in FIG. 3 will be described. As shown in FIG. 3, the completed tie 70 according to an embodiment of the present invention comprises three elements, the core 100, inner sleeve 90 and outer sleeve 80. To construct the core 100, a whole railroad tie in a 7"×9"×8'-6" size is first obtained. The whole railroad tie is then cut to the desired length, and then cut in half longitudinally to make two cores 100, nominally 4.5" tall and 7" wide. One core 100 is set aside for later use. For the inner sleeve 90, PET regrind is first obtained. Regrind refers to plastic feed stock that has been sorted, ground, cleaned, and otherwise processed to be ready to be used immediately. The PET regrind is then preferably mixed with a fine virgin rubber dust. A stabilizer is also preferably added to the PET regrind. The PET, rubber dust and stabilizer are placed in a blender and blended. The PET mixture is then transferred to an injection molding machine. For the outer sleeve 80, HDPE regrind is first obtained. The HDPE regrind is then preferably mixed with a fine rubber dust, either de-vulcanized, recycled rubber or virgin rubber. A stabilizer is also preferably added to the HDPE regrind. The HDPE, rubber dust and stabilizer are placed in a blender and blended. The HDPE mixture is then transferred to an injection molding machine.

A mold is formed in the desired shape of the final product. If two layers of sleeves are desired, two molds may be necessary. Alternatively, molds are available that may reconfigure themselves, allowing both layers to be formed in a single mold. The core 100 may be suspended in the mold in various ways, such as by a rod. The hole in the sleeves resulting therefrom may be filled in at a later time.

The 4.5"×7" core 100 is placed in the mold. Then, the PET injection molding machine supplies the PET mixture into the mold to form the inner sleeve 90. After the inner sleeve 90 is formed, the HDPE injection molding machine supplies the HDPE mixture in the mold to form the outer sleeve 80. Alternatively, if a single mold is used for both layers, PET is first injected, then allowed to cool. Then, the mold may be reconfigured, and the HDPE may be injected into the mold.

Figure 10:
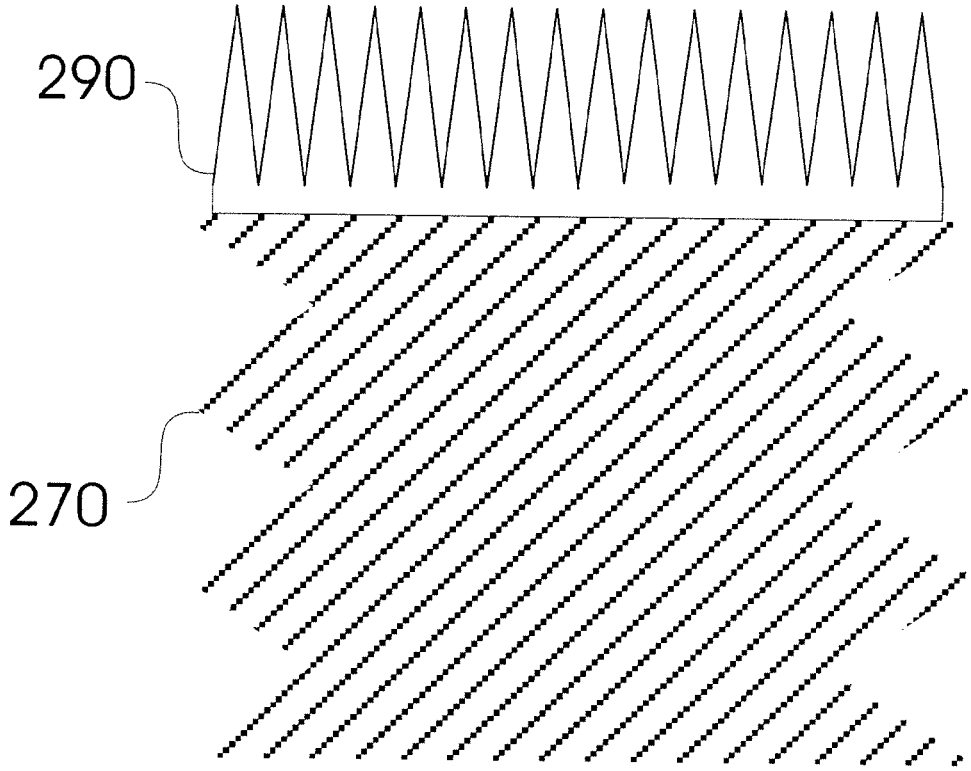
FIG. 10, a cross sectional view of the core and the inner sleeve during manufacture in an embodiment.
Figure 11:
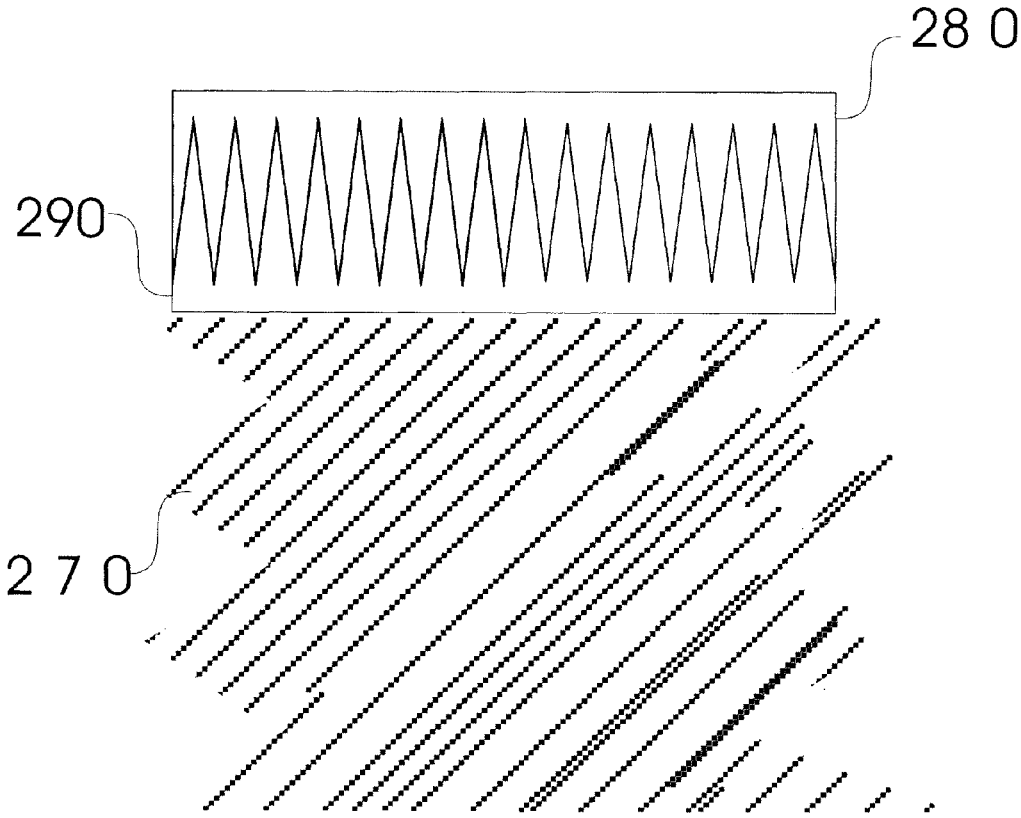
FIG. 11, a cross sectional view of the core, inner sleeve, and outer sleeve according to an embodiment.

In a preferred embodiment and referring to FIG. 10, the inner sleeve 290 is molded so as to have a solid base layer in contact with the core 270, with fingers protruding therefrom. These fingers give inner sleeve 290 a ridged surface. FIG. 11 shows a cross-section of a portion of a completed tie. It shows inner sleeve 290, including fingers, as well as the outer sleeve 280 having opposite, interlocking fingers, and a solid layer. In a preferred embodiment, the sides and top of the tie comprise an inner sleeve 290 having a 0.25" thick solid layer and 0.5" fingers, as well as an outer sleeve 280 having 0.5" fingers and a 0.25" solid layer, resulting a total thickness of 1.0" because the fingers interlock. Given a 7" wide core 270, this results in the desired final width of 9". The bottom of the tie is preferably formed in a similar fashion, only differing in that the outer sleeve 280 additionally includes 0.5" of high friction ridges. By forming the first and second sleeves in the above fashion, the sleeves may be formed and cooled quicker than if, for instance, each of the two sleeves were a 0.5" solid layer. This is because two sleeves, each having a 0.25" solid layer with 0.5" interlocking fingers, will cool quicker than two sleeves, each a 0.5" solid layer, even though both result in a total encapsulation of 1.0".

In an alternate embodiment, rather than obtaining PET and HDPE regrind, PET and HDPE recyclate may instead be obtained. Recyclate refers to plastic feed stock that has been sorted by type but requires further processing to remove contaminants, such as labels and traces of previous contents, and grinding before being ready for use. Before being introduced to the respective mixers and if the PET or HDPE recyclate is obtained in baled form, the PET or HDPE bales are placed in a debaler, wherein the bales of PET or HDPE recylate are broken apart into a more manageable stream of recyclate. PET or HDPE recyclate from the debaler is then forwarded to a shredder, wherein the large pieces of PET or HDPE recylate are reduced into smaller shreds of plastic. The shreds of PET or HDPE are then forwarded to a separator, which separates the PET or HDPE from non-plastic elements such as labels. The non-plastic elements may be removed to a closed effluent furnace where they can be burned as fuel to generate some electricity. The separated shreds of PET or HDPE may used identically to the PET or HDPE regrind above.

In another embodiment, old and scrap ties may be recycled to obtain new cores 100. First, remaining metal, such as plates and spikes, are removed from the old and/or scrap ties. The ties are then rendered into fibers and strands which are sorted. Rotten, overly short, or otherwise undesirable fibers may be disposed of by sending them to a closed effluent furnace to be burned to generate electricity. The remaining fibers may then be mixed with a binder such as, for instance, an iso-cyanate resin, heated and pressed to form a large sheet or billet. The large sheet or billet may then be processed to create ready-to-use cores of a desired size, which may be used identically to the 4.5"×7" cores 100 in the process described above. The core 100 produced by the this method is greater than 80% wood fibers, by weight.

In another embodiment, scrap tires may be recycled to obtain rubber dust. Scrap tires may first be subject to a gross shred which turns the tires into crumbs. At this stage, the tire crumbs still contain metal fibers, such as remnants of steel belting and valves, and the rubber in the tire crumbs is vulcanized. Tire crumbs may be used as fuel in a closed effluent furnace. Alternatively, the tire crumbs may be finely shredded to de-vulcanize the rubber. The resulting finely shredded rubber dust may be used instead of the virgin rubber dust in the process described above. The shredding process also separates the metal from the shredded rubber dust. The metal may then be sold to a recycler.

While we have shown illustrative embodiments of the invention, it will be apparent to those skilled in the art that the invention may be embodied still otherwise without departing from the spirit and scope of the claimed invention. For instance, although the exemplary embodiments disclosed above have been generally limited to the traditional rectangular-shaped tie, non-rectangular embodiments also lie within the scope of the present invention.

The invention claimed is:

1. A railroad tie comprising:

a core comprising wood, wood-product, engineered wood product, or engineered plastic;

a first sleeve encapsulating the core, wherein the first sleeve comprises at least polyethylene terephthalate (PET) and one or more additives;

a second sleeve encapsulating the first sleeve, wherein the second sleeve comprises at least one of the group consisting of plastic, plastic-composite, or non-plastic polymers;

wherein an outer surface of the first sleeve comprises first fingers protruding therefrom and having gaps between the first fingers, and wherein the second sleeve comprises second fingers filling the gaps between the first fingers; and wherein each of the first and second sleeves is molded as a solid layer with a plurality of the fingers protruding from the solid layer to a length substantially greater than a general thickness of the respective solid layer from which the fingers protrude.

2. The railroad tie of claim 1, wherein the first sleeve further comprises a colorizing additive.

3. The railroad tie of claim 1, wherein the second sleeve further comprises a colorizing additive.

4. The railroad tie of claim 1, wherein a bottom side of the railroad tie further comprises protruding ridges forming closed shapes.

5. The railroad tie of claim 4, wherein the shapes formed on the bottom side of the railroad tie include chevrons.

6. The railroad tie of claim 4, wherein at least some of the protruding ridges on the bottom side of the railroad tie have a height of approximately one half inch.

7. The railroad tie of claim 1, wherein a top side of the railroad tie is patterned with a glare resistant pattern.

8. The railroad tie of claim 1, wherein a bottom side of the railroad tie further comprises a protruding ridge.

9. The railroad tie of claim 1, wherein the second sleeve comprises at least high density polyethylene (HDPE) and one or more additives.

10. The railroad tie of claim 1, wherein the first fingers narrow as the first fingers extend further from the core.

11. A system for supporting railroad rails, comprising:

a railroad tie comprising a core comprising wood, wood-product, engineered wood product, or engineered plastic, a first sleeve encapsulating the core, wherein the first sleeve comprises at least one of the group consisting of plastic, plastic-composite, or non-plastic polymers, and a second sleeve encapsulating the first sleeve, wherein the second sleeve comprises at least one of the group consisting of plastic, plastic-composite, or non-plastic polymers but is of a different material than the first sleeve, and wherein an outer surface of the first sleeve comprises first fingers protruding therefrom, and wherein an inner surface of the second sleeve comprises second fingers protruding therefrom, wherein the first fingers occupy gaps between the second fingers, and wherein the first fingers narrow as the first fingers extend further from the core, and wherein a bottom surface of the second sleeve includes protruding ridges that form closed shapes, and wherein each of the first and second sleeves is molded as a solid layer with a plurality of the fingers protruding from the solid layer to a length substantially greater than a general thickness of the respective solid layer from which the fingers protrude;

ballast material below and around the railroad tie; and a plurality of rails mounted on the railroad tie.

12. A method for supporting railroad rails comprising:

laying ballast material on a surface;

placing, on the ballast material, a railroad tie comprising a core comprising wood, wood-product, engineered wood product, or engineered plastic, a first sleeve encapsulating the core, wherein the first sleeve comprises at least one of the group consisting of plastic, plastic-composite, or non-plastic polymers, and a second sleeve encapsulating the first sleeve, wherein the second sleeve comprises at least one of the group consisting of plastic, plastic-composite, or non-plastic polymers, and wherein an outer surface of the first sleeve comprises first fingers protruding therefrom, and wherein an inner surface of the second sleeve comprises second fingers protruding therefrom, wherein the first fingers occupy gaps between the second fingers, wherein each of the first and second sleeves is molded as a solid layer with a plurality of the fingers protruding from the solid layer to a length substantially greater than a general thickness of the respective solid layer from which the fingers protrude; and mounting a plurality of rails to the railroad tie.

13. A method of manufacturing a railroad tie, comprising:

obtaining a core comprising wood, wood-product, engineered wood product, or engineered plastic;

obtaining a first sleeve material comprising plastic, plastic-composite, or non-plastic polymers;

obtaining a second sleeve material comprising plastic, plastic-composite, or non-plastic polymers;

placing the core into a first mold;

melting the first sleeve material and injecting molten first sleeve material into the first mold containing the core so that the first molten sleeve material encapsulates the core and includes a solid layer and first fingers with gaps between the first fingers, and wherein a plurality of the first fingers protrude from the solid layer to a length that is substantially greater than a general thickness of the solid layer of the first sleeve;

cooling the encapsulated core;

removing the encapsulated core from the first mold;

placing the encapsulated core into a second mold;

melting the second sleeve material and injecting the molten second sleeve material into the second mold containing the encapsulated core so that the second molten sleeve material forms a solid layer and flows between the first fingers to form the second fingers while encapsulating the previously encapsulated core and forming contours on at least one outer side of the twice encapsulated core, and wherein a plurality of the second fingers protrude from the solid layer to a length that is substantially greater than a general thickness of the solid layer of the second sleeve;

cooling the twice encapsulated core; and removing the twice encapsulated core from the second mold.

14. The method of manufacturing a railroad tie of claim 13, wherein the first sleeve material comprises polyethylene terephthalate (PET) and one or more additives.

15. The method of manufacturing a railroad tie of claim 13, wherein the second sleeve material comprises at least high density polyethylene (HDPE) and one or more additives.

16. The method of manufacturing a railroad tie of claim 13, wherein the contours on at least one outer side of the twice encapsulated core further comprise protruding ridges on a bottom side of the railroad tie.

17. The railroad tie of claim 13, wherein the contours on at least one outer side of the twice encapsulated core further comprise a plurality of channels in the bottom side of the railroad tie.

18. A railroad tie comprising:

a solid core;

an injection molded first sleeve encapsulating the core, wherein the first sleeve comprises at least one of the group consisting of plastic, plastic-composite, or non-plastic polymers and includes an outer surface having at least one side comprising protruding first fingers; and an injection molded a second sleeve encapsulating the first sleeve, wherein the second sleeve comprises at least one of the group consisting of plastic, plastic-composite, or non-plastic polymers and includes second fingers; and wherein each of the first and second sleeves is molded as a solid layer with a plurality of the fingers protruding from the solid layer to a length substantially greater than a general thickness of the respective solid layer from which the fingers protrude.

19. The railroad tie of claim 18, wherein the first sleeve comprises at least poly ethylene terephthalate (PET) and one or more additives.

20. The railroad tie of claim 18, wherein the second sleeve comprises at least high density poly ethylene (HDPE) and one or more additives.

* * * * *